US010161102B2

(12) United States Patent
Horton

(10) Patent No.: US 10,161,102 B2
(45) Date of Patent: Dec. 25, 2018

(54) EXCAVATOR ATTACHMENTS ALIGNMENT TOOL

(71) Applicant: Lee A. Horton, Jefferson, MA (US)

(72) Inventor: Lee A. Horton, Jefferson, MA (US)

( * ) Notice: Subject to any disclaimer, the term of this patent is extended or adjusted under 35 U.S.C. 154(b) by 185 days.

(21) Appl. No.: 15/211,415

(22) Filed: Jul. 15, 2016

(65) Prior Publication Data

US 2017/0030048 A1 Feb. 2, 2017

Related U.S. Application Data

(60) Provisional application No. 62/197,798, filed on Jul. 28, 2015.

(51) Int. Cl.

| | |
|---|---|
| ***B25B 27/04*** | (2006.01) |
| ***E02F 9/28*** | (2006.01) |
| ***E02F 3/36*** | (2006.01) |
| ***E02F 3/40*** | (2006.01) |
| ***E02F 5/32*** | (2006.01) |

(52) U.S. Cl.

CPC ..... *E02F 3/3686* (2013.01); *B25B 27/04* (2013.01); *E02F 3/3636* (2013.01); *E02F 3/40* (2013.01); *E02F 5/32* (2013.01); *E02F 9/2891* (2013.01)

(58) Field of Classification Search

CPC ..... B25B 27/02; B25B 27/04; E02F 3/3609; E02F 3/3686; E02F 3/40; E02F 3/3636; E02F 5/32; E02F 9/2891; E02F 9/2841

USPC ..... 37/403–409, 444, 468; 29/426.5, 255, 29/275, 278, 280, 283, 525; 81/463, 489; 403/315, 326, 325; 414/723, 724

See application file for complete search history.

(56) References Cited

U.S. PATENT DOCUMENTS

| | | | | |
|---|---|---|---|---|
| 4,100,688 | A * | 7/1978 | Grist | E02D 3/026 172/254 |
| 4,188,701 | A * | 2/1980 | Ludwig | B25B 27/02 254/131 |
| 5,058,257 | A * | 10/1991 | Freestone | B25B 27/04 29/275 |
| 5,727,342 | A * | 3/1998 | Horton | E02F 3/3622 37/468 |
| 6,883,221 | B1 * | 4/2005 | Hayes, III | B25B 27/04 29/253 |
| D522,819 | S * | 6/2006 | Launder | D8/16 |
| 7,322,133 | B2 | 1/2008 | Horton | |

(Continued)

*Primary Examiner* — Robert E Pezzuto

(74) *Attorney, Agent, or Firm* — Fish & Richardson P.C.

(57) ABSTRACT

An excavator attachment alignment tool has cooperating tool body portions mounted to a cross tube defining an axis. The tool body portions are moveable relative to the cross tube to define a lower hook portion having surfaces to accommodate and support an engaged excavator attachment pin parallel with the tool axis, with the lower hook portion positionable for lifting engagement with the excavator attachment pin. Aligned cylindrical bushings are mounted to opposed surfaces of the body portions in alignment with the tool axis, with the cross tube engaged and extending generally between the bushings, with spacing of the cooperating tool body portions fixedly adjustable along the tool axis for accommodating a width of an associated excavator link or stick to which an excavator attachment is to be attached or removed; and wherein the tool body portions are mounted in a manner to resist independent rotation of either body portion.

13 Claims, 9 Drawing Sheets

(56) References Cited

U.S. PATENT DOCUMENTS 8,443,504 B2 * 5/2013 Clendenning ..... B25B 27/04
29/255

* cited by examiner

EXCAVATOR ATTACHMENTS ALIGNMENT TOOL

CROSS REFERENCE TO RELATED APPLICATIONS

This application claims benefit of prior U.S. Provisional Application 62/197,798, filed on Jul. 28, 2015. The application is incorporated by reference in its entirety.

TECHNICAL FIELD

This invention relates to excavator attachments, and, in particular, to alignment tools for mounting and removing excavator attachments.

BACKGROUND

Excavators and backhoes of conventional construction, e.g. as described in Horton U.S. Pat. No. 7,322,133, the complete disclosure of which is incorporated herein by reference, are known in the prior art. By way of example, and with reference to FIGS. 12A and 12B of the present application, a hydraulic excavator 100 has a chassis 114 with a cab 118 for the operator. Extending from the chassis 114 is a boom 122 pivotally attached to the chassis, and a dipper stick 124 pivotally attached at the outboard end of the boom 122. The dipper stick 124 connected to the boom arm 122 is moved in and out by means of a hydraulic boom cylinder 126. An excavator attachment, e.g., a multi-shank ripper excavator attachment or tool 112, as taught in the Horton '133 patent mentioned above, is removably connected to the dipper stick 124 at a stick pivot or pin 132 and to a 4-bar linkage 142 (connected to a hydraulic bucket cylinder 130) at a link pivot or pin 134.

As described above, and referring also to FIG. 4, excavator and backhoe attachments, such as buckets of different widths and types, e.g. ripper bucket 50 (FIG. 6), ripper 52 (FIGS. 8) and 112 (FIGS. 12A and 12B), and other tools, are typically connected to the machine stick 124 and to the link 142 by horizontal pins, i.e., stick or hinge pin 132 and link pin 134. The stick pin 132 is held in place by engagement of a cross bolt 150 in aligned cross drilled hole 154 through the stick pin 132 and an associated stick pin locking collar 156, and the link pin 134 is similarly held in place by engagement of a cross bolt 150 in aligned cross drilled hole 158 through the link pin 134 and an associated link pin locking collar 160. The stick pin locking collar 156 and the link pin locking collar 160 are welded to the mounting plate (or "ear") surface 166 of the excavator attachment. In turn, the cross bolts are secured in place by cooperating threaded nuts 152 at the opposite side of the collar 156, thereby to resist rotation and movement of the pins 132, 134 relative to the excavator attachment (only one cross bolt 150 and threaded nut 152 are shown, by way of example). This arrangement is described and discussed below in more detail, e.g., with reference to FIG. 4).

In other implementations, e.g., referring to FIG. 12B, a quick change coupler 164 may be used in place of the excavator attachment 128, with the coupler 164 connected to the stick pivot pin 132 and link pin 134 by a set of two pins and an arrangement of hooks and locks that grab a second set of two pins mounted on the attachment.

In still another implementation, mechanical and hydraulic "pin-grabber" couplers can also simplify the action of connecting the excavator attachment 112 to the stick 124 and link 142.

Changing excavator attachments 112 on an excavator or backhoe 100 without use of a quick change coupler 164 is recognized as being very difficult. For example, the operator must use a punch pin and a hammer to pound the linkage attachment pins 132, 134 into place and out of place. When pounding the pins into place for a new connection, it is very difficult to align each pin so that the retention cross bolt holes 154, 158 through the pins 132, 134 and their respective locking collars 156, 160 are aligned, in order to receive the cross bolts 150. This method is known to be difficult, dangerous, messy, and to require two operators to accomplish it efficiently. Initially, to begin the process, the operator may gently rest the excavator attachment 112 on the ground; however, after a few short minutes, hydraulic valve spool leakage allows the combined weight of the stick 124 and boom 122 to cause the boom and stick to sag due to the hydraulic leakage drift. As a result, the entire weight of the stick and boom ends up resting on the linkage and attachment pins. During the changing operation, the operator tries to pound the pins 132, 134 out of place, but when one pin finally pops out, e.g. the stick pin 132, the stick 124 drops, and the punch pin (not shown) becomes trapped in the bucket bore, pinched by the stick. The operator must then get back into the machine cab and lift the 124 stick with the hydraulic power, thereby seeking to free the punch. The operator then has to pound the link pin 134 out of place in a similar fashion. After the first excavator attachment (e.g. tool 112) has been disconnected, the operator must swing the linkage over while attempting to align the stick bosses 170 (FIG. 4, where only one is seen) with the attachment bosses 172 (again, only one is seen). Most of the time, the second attachment is not sitting on a flat portion of the ground and it is not fully square to the machine, so aligning the stick 124 to the attachment bosses 172 is very difficult.

Once the stick and the replacement excavator attachment are aligned, the operator begins to pound the stick 132 into place from one side of the replacement attachment 112', and then into the stick boss bore 170, to complete the pivot. Again, because the stick 124 and boom 122 begin to slowly drift and sag lower due to hydraulic valve spool leakage, aligning the attachment pin bore 172 to the link bore 170 is very difficult. After the stick pin 132 is finally engaged into one side of the stick bore 170, the pin must be pounded fully into place with a hammer until the end of the pin is visible on the opposite side of the attachment 112'. A cross bolt 150 is inserted to secure the pin 132 to the bucket 112'; however, it is very difficult to align the segments of locking bolt cross hole 158 (through the stick pin and through both sides of the stick pin locking collar 156) due to the weight of the stick 124 and boom 122 on the pin 132, so the weight must again be lifted off the stick 124, and the pin 132 rotated into alignment of the pin bolt hole segments so that the bolt 150 can be inserted. When the boom 122 and arm 120 are lifted, the weight of the attachment 112 again makes it difficult to rotate the pin 132, thus requiring more pounding and difficulty. After assembly of the stick pivot pin 132 is complete, the link pin 134 can be pounded into place, typically with a little less difficulty, but the task is still considered to be difficult and dangerous.

In fact, many equipment operators have suffered pinched, or even severed, fingers performing this operation. The task can also be very messy due to the grease covering the components. For these reasons, quick couplers 164 are recognized as a huge benefit to the industry. Additionally, use of quick couplers may allow some operators to change tools many times per day, so not having to pound pins into position is a huge benefit. The easier it is to change attachments, the more likely it is that an operator will change attachments frequently in order to employ the attachment best suited for the job being performed. In contrast, prior to use of quick change couplers, an operator often felt forced to continue to use a tool ill-suited for a segment of job, thereby to avoid the difficulty and downtime of making a change. As a result, having the ability to change attachments easily not only makes the job safer and faster for the operator, but it also makes the job more efficient and effective due to the increased frequency of use of the correct excavator attachment.

There are, however, situations in which the use of a quick change coupler 164 is not advantageous. For example, in digging and ripping applications, where the shortest tip radius is often desirous, using a quick change coupler may not be the best alternative because the coupler increases the tip radius, thus reducing the overall breakout force of the machine, e.g., use of a quick connect coupler can reduce breakout force by between 10% and 15%. Similarly, in other dig-and-load and lifting situations, a quick connect coupler 164 adds significant weight at the end of the stick 124, which decreases the payload that could otherwise be lifted safely. In addition, repeated lifting and lowering of a quick connect coupler increases fuel consumption and slows the cycle time of the digging operation, e.g. due to the extra weight. For example, a typical quick change coupler sized for use with 80 mm attachment pins weighs almost 1,000 pounds.

Hydraulic versions of pin-grabber couplers, e.g. as compared to mechanical versions, allow attachment changes to be made by an operator while remaining in the cab. However, the additional hydraulic valve and hydraulic plumbing of these couplers increases their complexity. These couplers and their plumbing components are also expensive, and introduce another possible source for contaminants in the hydraulic system. By way of example only, a typical hydraulic coupler for an excavator with 80 mm attachment pins may cost may cost as much as $8,000, not including the hydraulic kit, which can add another $4,000. The cost of a typical mechanical version of a pin-grabber coupler is, e.g., approximately $6,000.

SUMMARY

According to one aspect of the disclosure, an excavator attachment alignment tool comprises: a first alignment tool body portion and a cooperating second alignment tool body portion, the first and second cooperating alignment tool body portions mounted to a cross tube; the cross tube defining an alignment tool axis; and the cooperating alignment tool body portions being moveable relative to the cross tube into engagement to define a tapering, lower hook portion having opposed, spaced surfaces to accommodate and support an engaged excavator attachment pin in a position parallel with the alignment tool axis, the tapering, lower hook portion being positionable for lifting engagement with the excavator attachment pin, a pair of axially aligned cylindrical bushings mounted to opposed surfaces of the cooperating alignment tool body portions in alignment with the alignment tool axis, the cross tube engaged with and extending generally between the axially aligned cylindrical bushings; wherein, spacing of the cooperating alignment tool body portions, with the cylindrical bushings mounted thereto, is fixedly adjustable along the alignment tool axis for accommodating a width of an associated excavator link or excavator stick to which an excavator attachment is to be attached or to be removed; and wherein, the pair of cooperating alignment tool body portions is mounted in a manner to resist independent rotation of either of the pair of alignment tool body portions.

In preferred implementations of this aspect of the disclosure, at least one end of the cross tube is fixedly attached to a body portion of the pair of cooperating alignment tool body portions. The spacing of the cooperating first and second alignment tool body portions defines a first width between opposed inner surfaces of the cooperating first and second alignment tool body portions equal to a second width of the cooperating first and second alignment tool body portions at the lower hook portion. The excavator attachment alignment tool further comprises at least one member for locking axial positioning of at least one alignment tool body portion of the pair of cooperating alignment tool body portions relative to the cross tube. The member for locking axial position of the at least one alignment tool body portion is a locking collar. The opposed cylindrical bushings are sized for engagement within openings at opposite ends of an excavator stick boss or at opposite ends of an excavator link boss. Preferably, the excavator attachment alignment further comprises a pair of sleeve bushings, each sleeve bushing having an inner surface of diameter sized to be received over an outer surface of one of the cylindrical bushings in supporting engagement, and each sleeve bushing having an outer surface of diameter selected to be received within the openings at opposite ends of the excavator stick boss or at opposite ends of the excavator link boss in supporting engagement, thereby to accommodate use of the excavator attachment alignment tool with excavators having openings at opposite ends of the excavator stick boss or at opposite ends of the excavator link boss of a relatively greater diameters compared to the cylindrical bushings. The cooperating alignment tool body portions further comprise one or more guide plates mounted for sliding interengagement between the alignment tool body portions in a manner to resist independent rotation of either alignment tool body portion. The alignment tool body portions and the cross tube define cooperating interengageable structure for resisting independent rotation of either body portion. The lower hook portion is tapered toward the tip. With the excavator alignment tool engaged within the openings at opposite ends of the excavator stick boss or at opposite ends of the excavator link boss, and with an excavator attachment suspended by the hook portion of the excavator attachment alignment tool engaged with an excavator attachment pin having an excavator attachment pin axis, the excavator alignment tool axis and the excavator attachment pin axis engaged by the lower hook portion are disposed parallel to each other and disposed in alignment with the center of gravity of the suspended excavator attachment.

According to another aspect of the disclosure, an excavator attachment alignment tool is configured and arranged, when in use, to accommodate and support an engaged excavator attachment pin, to hold the excavator attachment pin with its axis parallel to an excavator linkage pin axis, and to hold an attachment longitudinal center plane co-planar with a linkage stick longitudinal center plane.

In preferred implementations of this aspect of the disclosure, the excavator attachment alignment tool, with an excavator attachment suspended from the alignment tool, the attachment pin axis and the excavator linkage pin axis are parallel, and define a second lateral plane that includes the center of gravity of the excavator attachment, thereby relieving radially-directed forces impeding insertion and removal of the connecting excavator attachment linkage pins and pin locking bolts.

According to still another aspect of the disclosure, a method for mounting and dismounting an excavator attachment using an excavator attachment alignment tool of the disclosure comprises the steps of: with an excavator machine running, lifting a presently mounted excavator attachment off the ground; extending or retracting a bucket cylinder to position the presently mounted excavator attachment with its center of gravity directly below a stick pivot; with the excavator attachment link pin now under little or no pressure, unbolting and pushing the link pin from the excavator link bore; swinging the link out of the way and inserting the attachment link pin back into the link bore of the first excavator attachment with no link; connecting the upper end of the excavator attachment alignment tool into one end of the link; positioning a lower hook portion of the excavator attachment alignment tool to generally encircle the first excavator attachment link pin; securing the excavator attachment alignment tool together with a proper width matching the width of the link; retracting the bucket cylinder to the first excavator attachment until its center of gravity is positioned directly below the link, with the excavator attachment link pin now being parallel to the excavator link pin bore, and the attachment center plane being aligned with the link center plane, and with the link vertical; with the pin under no pressure, unbolting and disengaging the stick or hinge pin;

inserting the stick or hinge pin into the link pin bore of the second excavator attachment; lowering the boom and moving the stick outward to lower the first excavator attachment to the ground, and releasing the excavator attachment alignment tool from the attachment pin of the first excavator attachment, with the second excavator attachment link pin now being parallel to the excavator link pin bore and the second excavator attachment longitudinal center plane now being aligned with the longitudinal excavator link center plane; engaging the excavator attachment alignment tool lower portion with the link pin of the second excavator attachment, and lifting the boom so that the second excavator attachment hangs freely; retracting the bucket cylinder so that the stick bosses of the second excavator attachment are positioned near the stick end; engaging the attachment pin into the bosses of the second excavator attachment and the stick boss by swinging or rocking the second excavator attachment into an easy insertion position, and bolting the attachment pin into place; extending the bucket cylinder so that the excavator attachment alignment tool is released from the link pin and the link boss is close to the second attachment link boss; removing the excavator attachment alignment tool; and inserting the link pin by swinging the excavator attachment fore and aft by hand, inserting the pin locking bolts, and securing the nut.

The excavator attachment alignment tool of this disclosure allows the excavator or backhoe operator to change excavator attachments without the use of a quick change coupler, and without having to deal with the difficulty of aligning linkage pins and pin locking bolts, and the associated heavy pounding required for placement and removal of stick and link pins.

The excavator attachment alignment tool of this disclosure also allows the operator to change excavator attachments without the cost, use and weight a quick change coupler, and without having to deal with heavy pin pounding and the difficult task of aligning the stick and link pins with locking collar cross bore segments for securement with threaded cross bolts and nuts.

The excavator attachment alignment tool of this disclosure allows the operator to employ a simplified method for removing an excavator attachment, and then mounting a new excavator attachment, regardless of the position or the flatness of the surrounding ground surface.

Changes of excavator attachments or tools can be completed with the excavator attachment alignment tool of this disclosure without the difficulties of hydraulic valve spool leakage drift mentioned above. Also, the excavator attachment is secured directly to the stick linkage, without an additional piece of equipment between stick linkage and the excavator attachment, so there is no reduction in breakout force. There is also no extra weight to reduce the amount of payload that can be lifted, or that can waste energy each time the boom is lifted.

Finally, by way of example only, the typical cost of an excavator attachment tool of this disclosure, e.g. for the 80 mm pin size, is approximately $1,060, which is less than about 20% of the cost of a mechanical quick change coupler.

The details of one or more implementations of the invention are set forth in the accompanying drawings and in the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
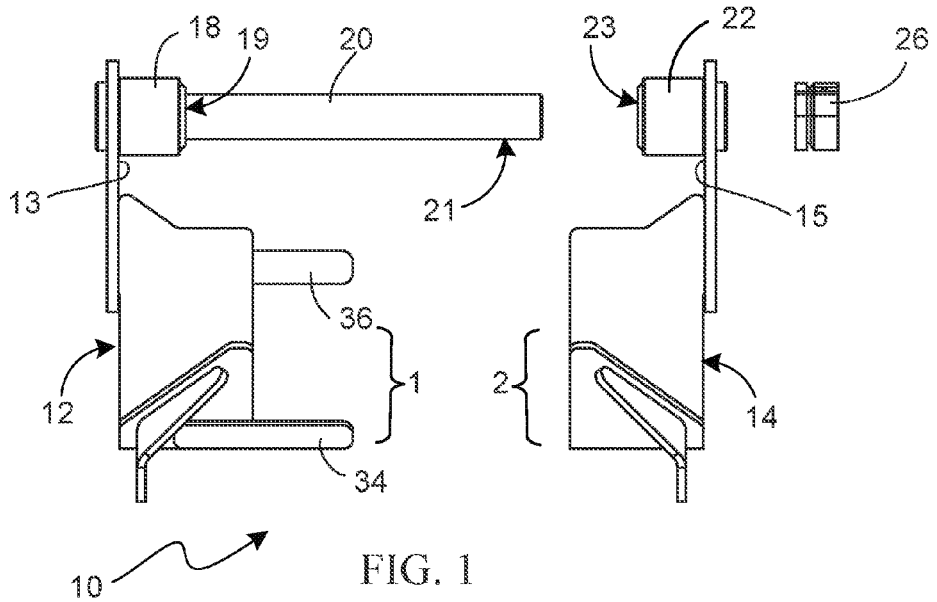
FIG. 1 is an exploded front view of the components of an excavator attachment alignment tool of the disclosure, including a first (left) alignment tool body portion, a second (right) alignment tool body portion, and a locking collar.
Figure 2:
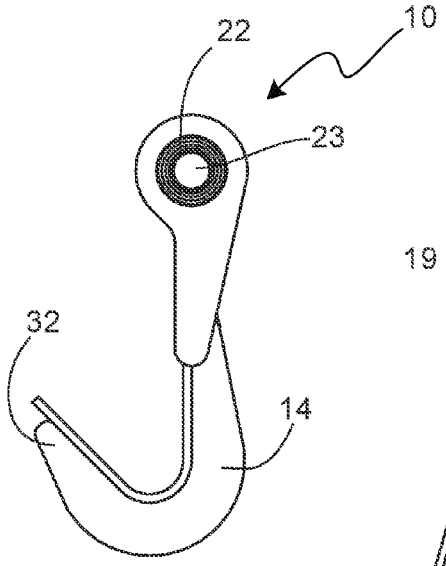
FIG. 2 is a right side view of the excavator attachment alignment tool assembly of FIG. 1, with a hook portion formed in the lower region.
Figure 3:
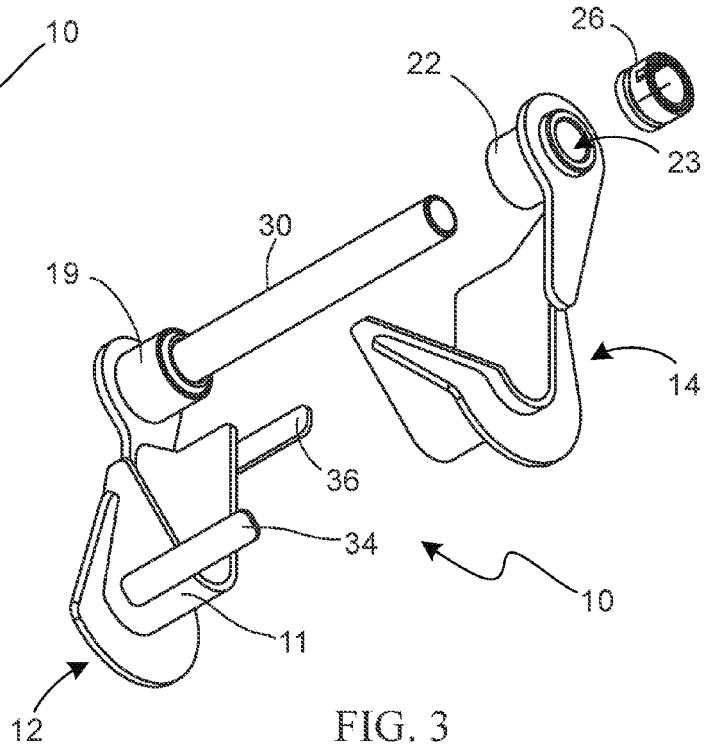
FIG. 3 is an exploded isometric view of the components of the excavator attachment alignment tool of FIG. 1.

Referring to FIGS. 1, 2 and 3, an excavator attachment alignment tool 10 of the present disclosure consists of a first (or left) body portion 12 and second (or right) body portion 14. A first cylindrical bushing 18 is mounted to an inner surface 13 of the first body portion 12, with the cylindrical bushing 18 defining a pivot bore 19. A second cylindrical bushing 22 is mounted to an opposed inner surface 15 of the second body portion 14, with the cylindrical bushing 22 defining a pivot bore 23. In this implementation, a cross tube 20 is secured, e.g. by welding, in the pivot bore 19 of cylindrical bushing 18.

The excavator attachment alignment tool 10 is assembled by sliding the free end 21 of cross tube 20 extending from the first body portion 12 through the pivot bore 23 of the cylindrical bushing 22 mounted to the opposed inner surface of the second body portion 14. A locking collar 26 is then slid onto the external exposed end 21 (FIG. 5) of cross tube 20. The locking collar 26 (which may be a commercially available lock ring) is spring loaded and provides a locking function that resists axial movement of the second body portion 14 outwardly along the exposed end of the cross tube or shaft 20 when the locking collar 26 is engaged.

The first and second body portions 12, 14 are then slid together along the cross tube 20. When adjustably assembled, the bottom regions 1, 2 of the respective first and second body portions 12, 14 of the alignment tool 10 cooperatively form a lower hook portion 32, and guide plates 34, 36 welded to rear (outer) surface 11 of the first body portion 12 serve to engage and hold the first and second body portions 12, 14 when the two body portions are slid together, thereby resisting relative rotation.

Commercially, different brands of excavator attachments having a common pin diameters may typically may have different link widths. The sliding adjustable inter-engagement of the first and second body portions 12, 14 of the excavator attachment alignment tool 10 of this disclosure thus permits positioning of the engaged body portions at variable combined width dimensions, W, thereby to accommodate a wide range of linkage widths, while also providing a hook of the proper width dimension.

Referring still to FIGS. 1, 2 and 3, the cross tube 20 of the excavator attachment alignment tool 10 of the disclosure is welded to the first or left side body segment 12. A relatively larger diameter cylindrical bushing 18 mounted on the tube has a diameter corresponding to the diameter of the smallest pin diameter in the excavator size class. The second or right side body portion 14 has a welded bushing 22 of similar, relatively large outside diameter. An excavator attachment alignment tool 10 of the disclosure is dimensioned for use with a pin having, e.g., an 80mm diameter for the class size shown, but can be adapted for use with excavator attachments having link pins and stick or hinge pins of other, relatively larger dimension.

Figure 10:
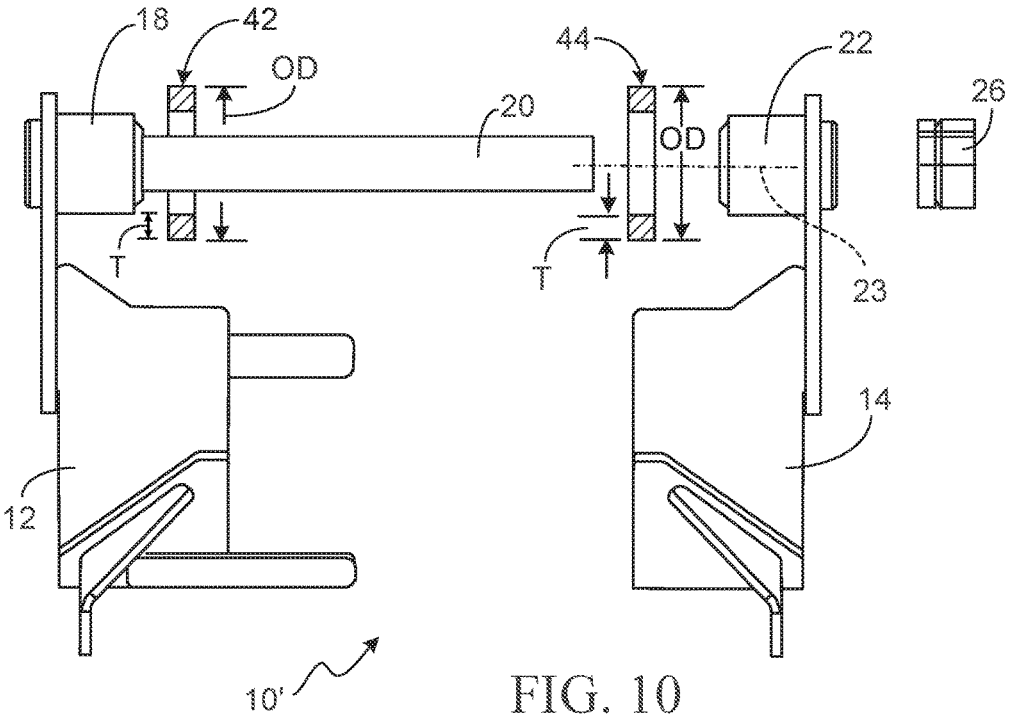
FIG. 10 is an exploded front view of the components of an excavator attachment alignment tool of the disclosure with diameter adjustment bushings.
Figure 11:
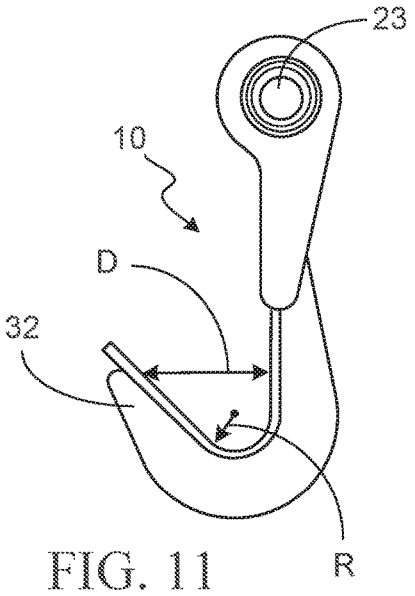
FIG. 11 is a right side view of the excavator attachment alignment tool assembly of FIG. 10 with a hook portion formed in the lower region.
Figures 12A, 12B:
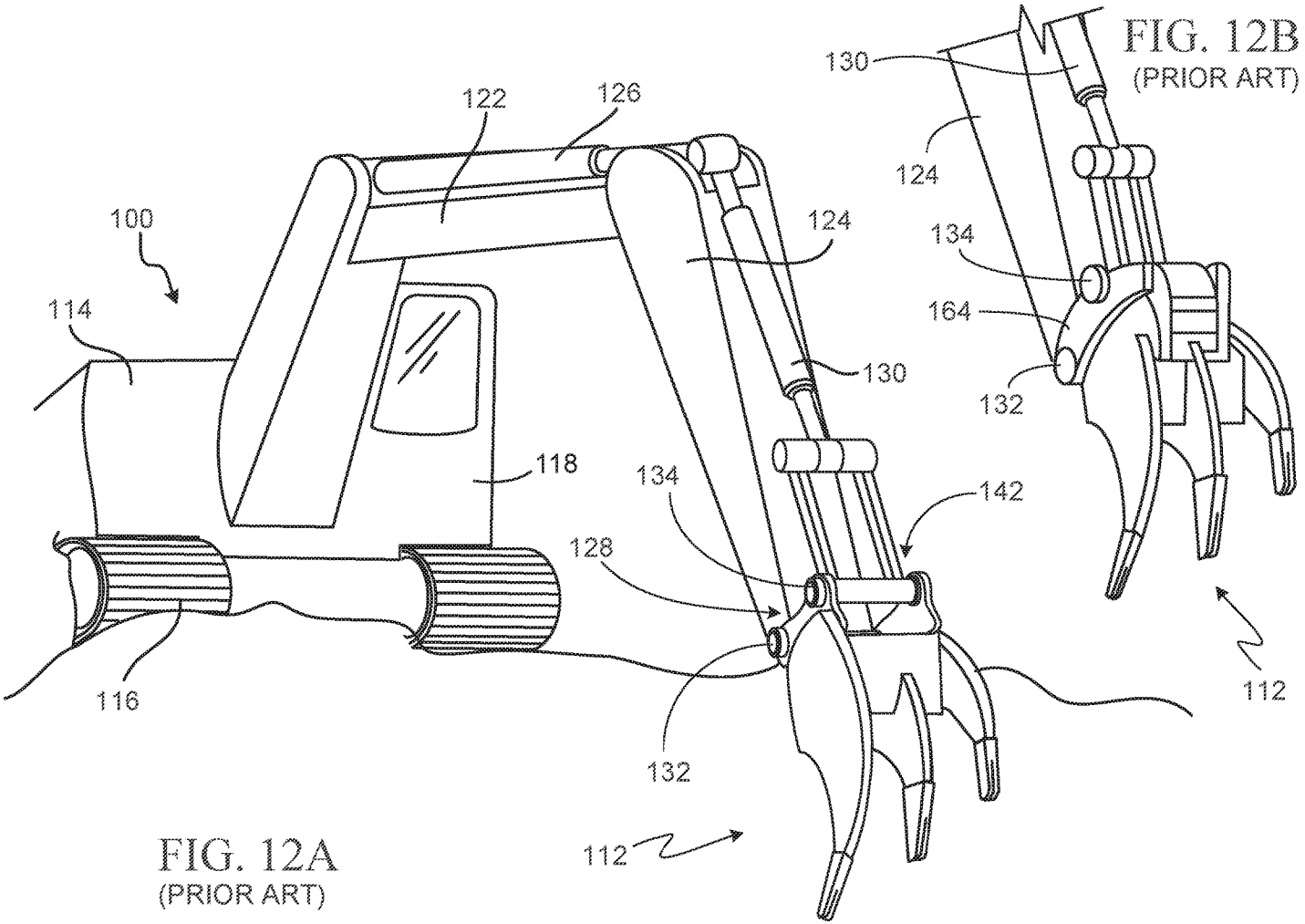
FIG. 12A (PRIOR ART)
FIG. 12B (PRIOR ART)
FIG. 12A is a prospective view of a hydraulic excavator with an excavator attachment arrangement fitted, e.g., with a multi-shank ripper excavation attachment.
FIG. 12B is prospective view of a hydraulic excavator fitted with a quick connect coupler, to which is mounted, e.g., a multi-shank ripper excavation attachment, all conventional and known in the prior art.

Referring briefly to FIGS. 10 and 11, by way of example only, adjustment bushings 42, 44, each having a wall of thickness, T, e.g. 5 mm, and an outside diameter, OD, e.g. 90 mm, can be slipped over the 80 mm welded bushings 18, 22, respectively, at each end of the cross tube 20, thereby to adjust the excavator attachment alignment tool 10 for use with a 90 mm size class machine (i.e., with an excavator attachment with link and stick or hinge pins having a 90 mm outer diameter). As a result, depending on the class size of the excavator, the excavator attachment alignment tool 10 of the disclosure can be quickly adapted for use, e.g., with 80 mm, 90 mm, 100 mm and 110 mm diameter link and stick or hinge pins, by simply sliding on adjustment bushings of the appropriate dimension. The inside radius, R, of the lower hook portion 32 typically corresponds to the smallest diameter pin size, i.e. in the case shown, 80 mm, at its base, but the opposed hook wall surfaces thereabove flare out to a relatively larger distance, D, apart, i.e. relatively greater than 2R, thereby to accommodate and align link and stick or hinge pins 132, 134 of relatively greater diameter.

Figure 4:
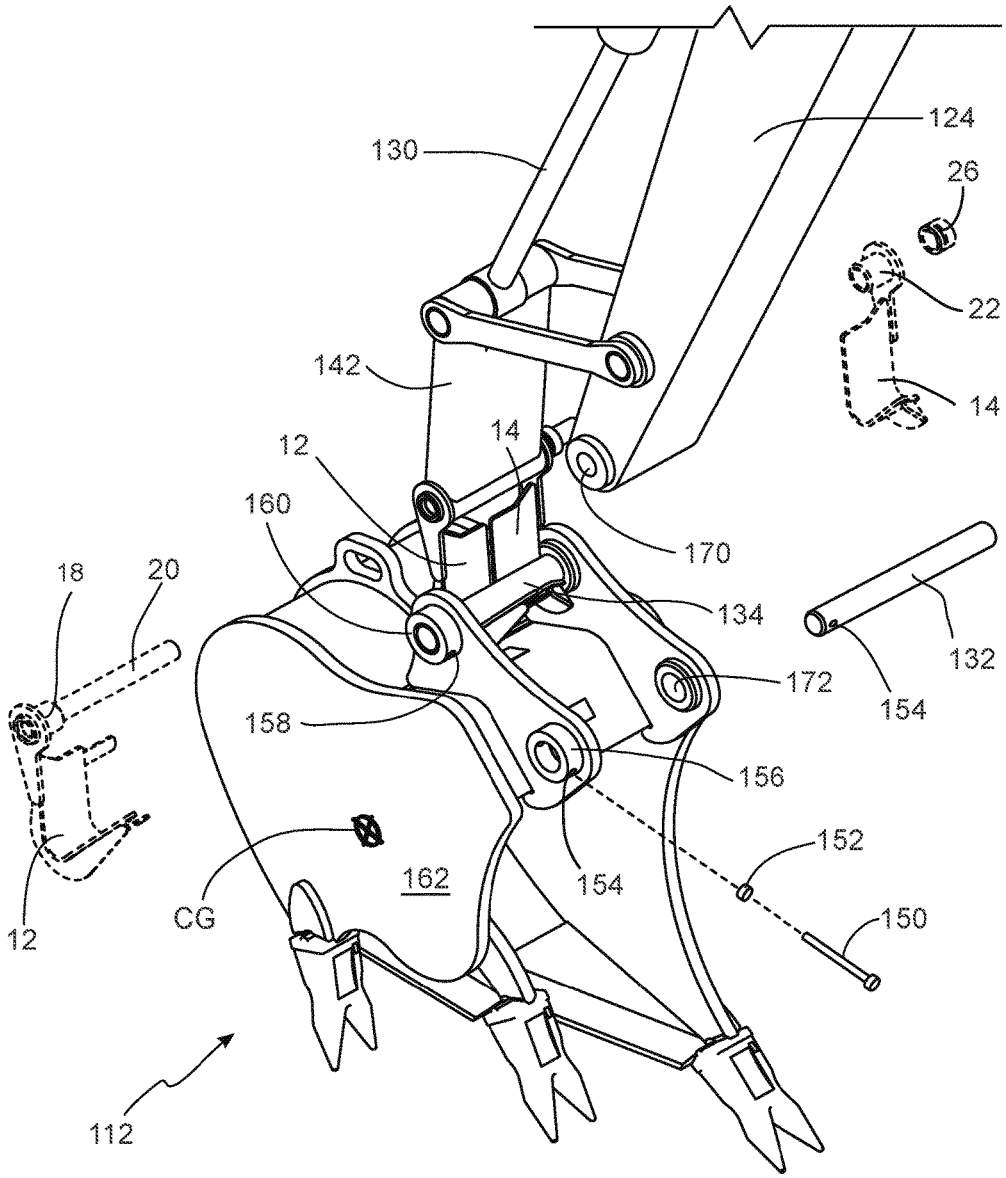
FIG. 4 is an exploded isometric view of the components of an excavator attachment, in this case a bucket, being supported by the excavator attachment alignment tool of FIG. 1, suspended from the excavator link boss. The stick is shown unattached, with the stick pin removed. For purposes of comparison and understanding, a second excavator attachment alignment tool of the disclosure is shown in dashed line, with its components (first (left) alignment tool body portion, second (right) alignment tool body portion, and locking collar) in unattached, exploded isometric view position.
Figure 5:
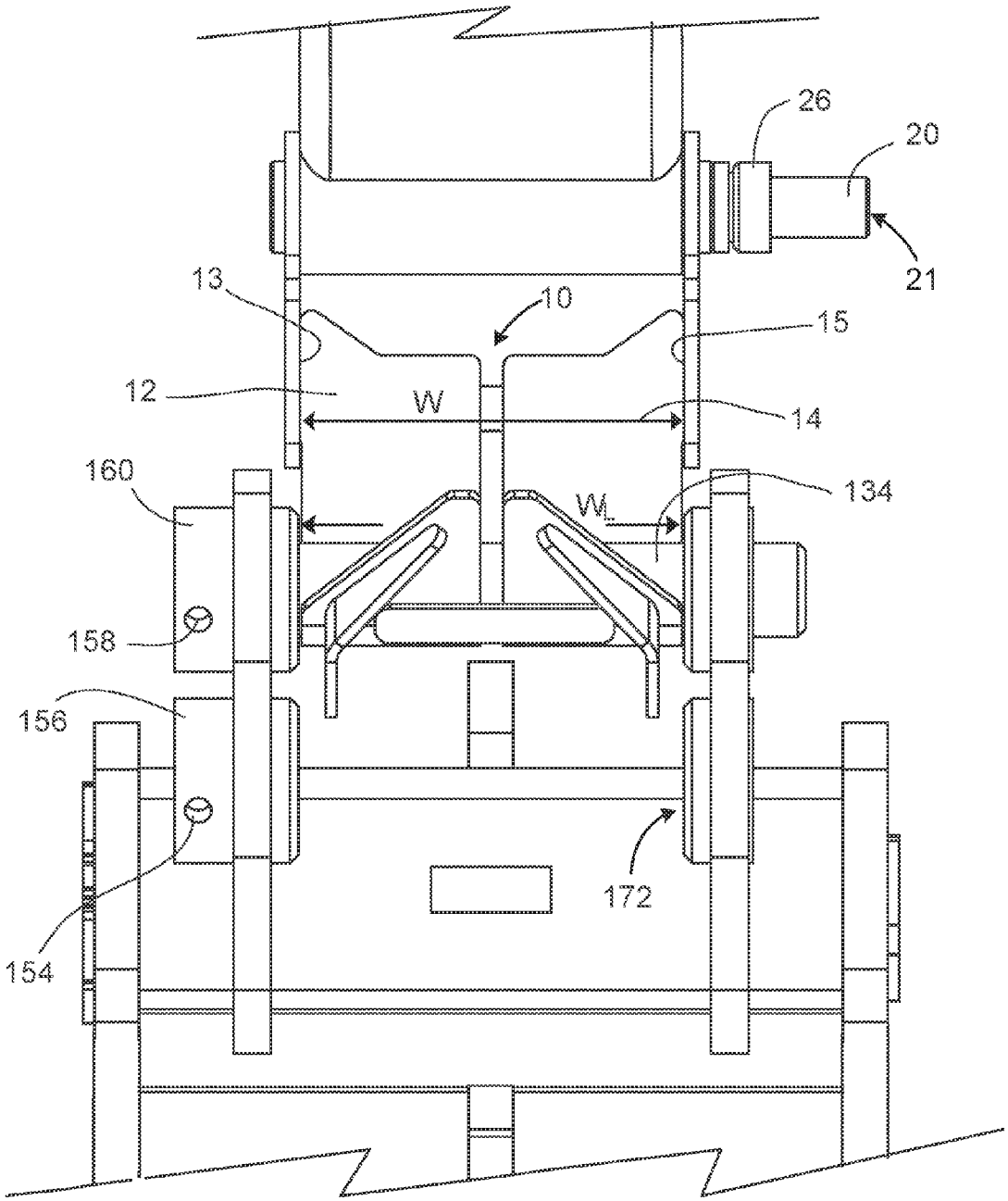
FIG. 5 is a front view of excavator attachment of FIG. 4, hanging from the hook portion of an excavator attachment alignment tool of the disclosure, suspended from the excavator link.
Figure 6:
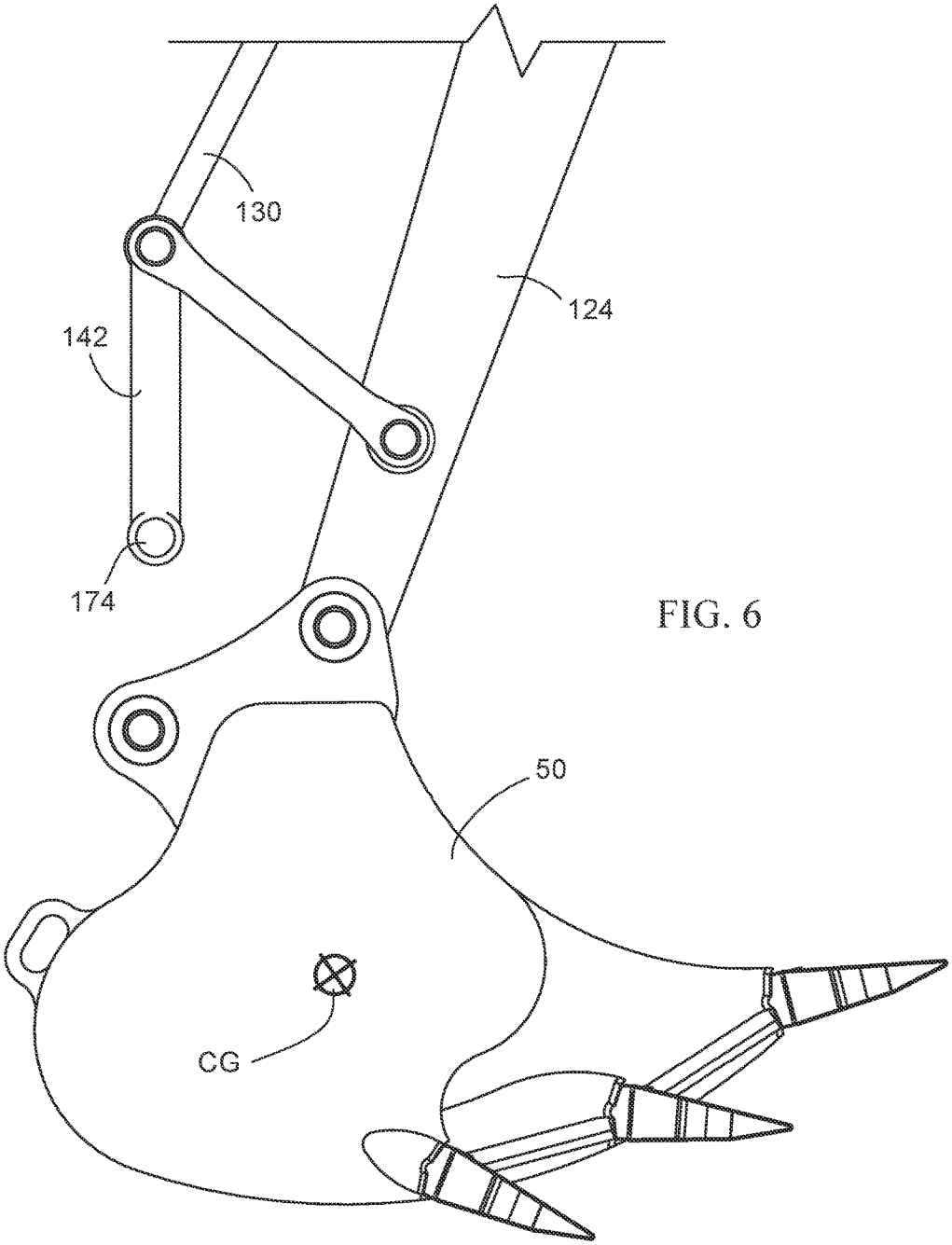
FIG. 6 is a left side view of the excavator stick and linkage, with the link pivot disconnected, and the excavator attachment (a bucket) hanging from the stick pivot, with the bucket center of gravity directly below the stick pivot.
Figure 8:
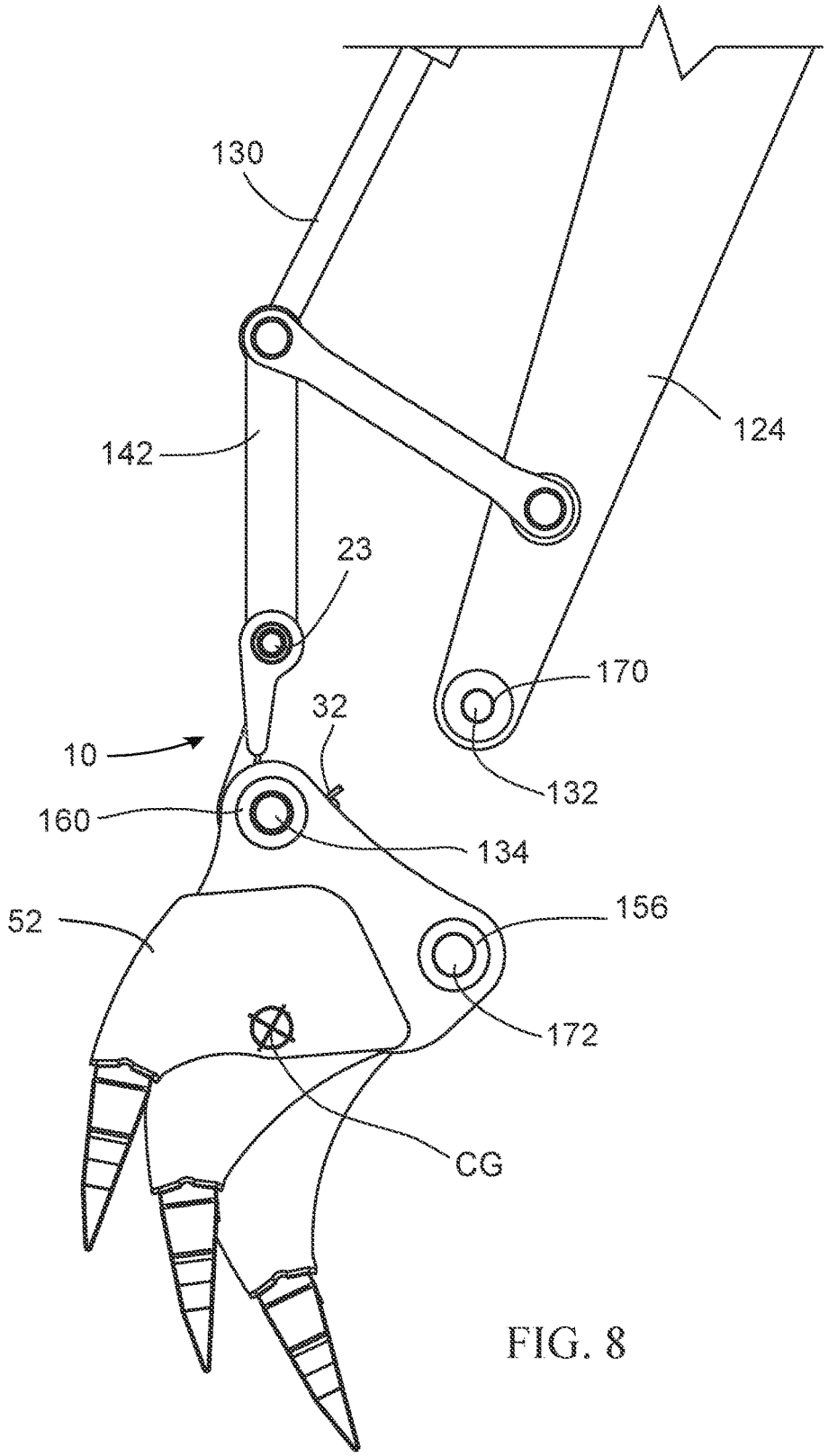
FIG. 8 is a left side view of the excavator stick and linkage, with the stick pivot unattached, and an excavator attachment (a ripper) hanging from the hook portion of an excavator attachment alignment tool of the disclosure connected to the link pivot, with the ripper center of gravity directly below the link pivot, and in alignment with the excavator attachment pin axis
Figure 9:
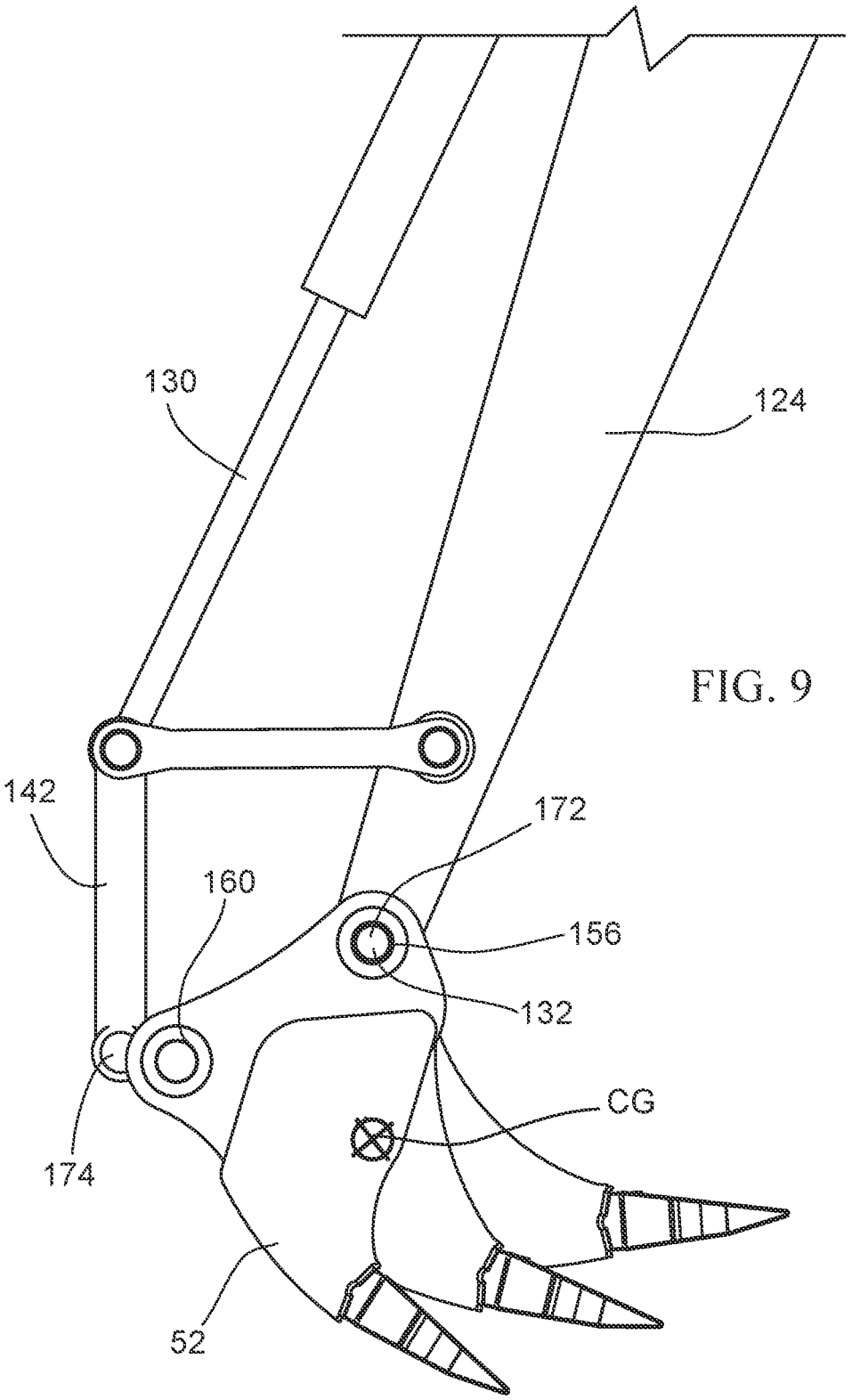
FIG. 9 is a left side view of the excavator stick and linkage with the link unattached and the excavator attachment (the ripper) hanging from the stick pivot with the ripper center of gravity directly below the stick pivot.

The width, $W_L$, at the lower end portion of the hook is the same as the width, W, between the opposed inner surfaces 11, 13 inside of the upper portions of the vertical plates (see, e.g., FIG. 5). When the alignment tool 10 is in use, the inner opposed surfaces 13, 15 of the respect first and second body portions 12, 14 are tightly engaged at opposed side surfaces of the link (or stick). The hook shape is such that an excavator attachment is easily "hooked" or picked up by engaging the lower hook portion 32 of the excavator attachment alignment tool 10 underneath an excavator attachment pin 132 or 134. The excavator attachment pin slides easily into the curve of the hook 32 of the excavator attachment alignment tool 10, and then aligns the excavator attachment so that the axis of the excavator attachment pin is axially aligned with the axis of the cross tube 20 of the excavator attachment alignment tool, and thus axially aligned with the link pin bore 174 of the excavator link 142 (FIG. 6). In this manner, the excavator attachment pin is arranged parallel to the link pin bore and the excavator attachment is aligned side-to-side in position for engagement and mounting to the excavator arm such that the excavator attachment longitudinal center plane is disposed in alignment with the longitudinal link center plane. As a result, the procedure for changing from a first excavator attachment (e.g., a Multi-Ripper bucket 50, FIGS. 4, 6 and 7) to a second excavator attachment (e.g., a non-bucket Multi-Ripper 52, FIGS. 8 and 9) is relatively simply achieved.

As described above, the excavator attachment alignment tool 10 consists of a first or right portion 12 and a second or left portion 14, with an upper end configured for secure engagement with and mounting upon the stick boss 170 or the link boss 174 of the excavator arm in the manner of the stick or hinge pin 132 or the link pin 134. The lower end portion of the alignment tool 10 has the form of a tapered hook 32 that assists in the dismounting (i.e., "dropping off") of the "old" excavator attachment already in use, and/or the mounting (i.e., "picking up") of a "new" excavator attachment. The excavator attachment alignment tool 10 allows the operator to change the stick or hinge pin 132 and link pin 134, one at a time, creating a sequence of conditions for each pin such that the pin force is low, and the excavator attachment is off the ground. The pin forces are low at the time of each pin insertion or removal because the alignment tool 10 allows the center of gravity (CG) of the excavator attachment to be in a position that relieves the force from the joint. Since the pin placement operations occur while there is a reduced level of force or load upon the link pin 134 or stick or hinge pin 132, the pin can be pushed in or removed relatively more easily (i.e., with relatively less force), and it is easier (again, with less force) to rotate the pins in order to align the cross bolt hole segment of the pin 132, 134 with the cross bolt hole segments of the respective locking collars 156, 160 for insertion of the locking bolts 150.

Also, as discussed above, a single model of the excavator attachment alignment tool 10 of the disclosure can be adapted for use across a range of several different excavator attachment pin diameters. For example, an excavator attachment alignment tool 10 of the disclosure can be used with a range of different excavator attachments, as long as the excavator attachment pin diameter is within the indicated range. Many excavators within a single size class have excavator attachments pins of a common diameter.

For example, excavator attachments such as Hitachi EX200, Cat 320, Case CX160 or CX210, John Deere 200, Komatsu PC200, and Linkbelt LX160 all have 80 mm pins for the excavator attachment linkage hook-up. As a result, for all of these excavator machines, a single model of the excavator attachment alignment tool 10 of this disclosure can be used without additional components. In addition, excavator machines having 90 mm, 100 mm or 110 mm diameter excavator attachment pins can also be adapted for use with the same excavator attachment alignment tool by the addition of sleeves or bushings of appropriately different diameters. Therefore, one model size of the excavator attachment alignment tool 10 of the disclosure can be used for excavator attachments with pin sizes from 80 mm up to 110 mm (i.e., the pin diameter range encompassing all mid-sized 40,000 to 110,000 pound excavator machine class sizes). A smaller model of the excavator attachment alignment tool of the disclosure, with sleeves having different diameters can accommodate 45 mm, 56 mm, 66 mm and 70 mm excavator attachment pins, e.g. as found in smaller excavators and backhoes in the 11,000 to 40,000 pound range). As a result, only two models of the excavator attachment alignment tool 10 of this disclosure are sufficient to cover excavators and backhoes from 11,000 pounds up to larger excavators weighing 110,000 pounds. By way of example only, the larger size excavator attachment alignment tool weighs approximately 55 pounds, while the smaller excavator attachment alignment tool weighs approximately 35 pounds.

Mini-excavators and backhoes that have excavator attachments with pin diameters less than 45 mm are typically easier to change, e.g. due to the relatively reduced weight of the excavator attachments. As a result, an excavator attachment alignment tool is less likely to be needed in that size range. Larger excavators having attachment pins with diameters greater than 110 mm would generally require an excavator attachment alignment tool that would be too heavy to lift manually.

We will now describe a typical procedure for use of the excavator attachment alignment tool 10 of the disclosure with one operator, and one helper for dismounting and mounting an excavator attachment:

Step 1: With the excavator machine 100 running, and the operator in the cab 118 to operate the excavator machine hydraulic controls, the presently mounted excavator attachment (e.g. an excavator bucket 50) is lifted about a foot off the ground. The bucket cylinder 130 is then extended or retracted so that the center of gravity (CG) of the currently mounted excavator attachment is directly below the stick pivot 132.

Step 2: With the excavator attachment link pin 134 now under no pressure, the helper unbolts and pushes the link pin 134 out of the excavator link bore 170. The link 142 is next swung out of the way, and the attachment link pin 134 is inserted back into the link bore 170 of the first excavator attachment 50 with no link (see, e.g., FIG. 6).

Step 3: The helper slides free end 21 of the cross tube 20 and then the cylindrical bushing 18 of the first or left body portion 12 of the excavator attachment alignment tool 10 into one end of the link 174, and then slides the second or right portion 14 of the excavator attachment alignment tool onto the free end 21 of the cross tube 20 and into the opposite end of the link boss 174, e.g. as shown FIG. 4). The helper positions the lower hook portion 32 of the excavator attachment alignment tool 10 to generally encircle the first excavator attachment (link) pin 134, and then slides the locking collar 26 onto the end 21 of the cross tube 20, thereby to secure the first and second hook portions 12, 14 of the excavator attachment alignment tool 10 together with proper width, W, matching the width of the link 142 (see FIG. 5).

Step 4: The operator next retracts the bucket cylinder 130, thus lifting the first excavator attachment 50 until the center of gravity, CG, of the excavator attachment is positioned directly below the link 134, and the link 142 is vertical. Then, with the pin 134 under no pressure (see FIG. 7), the helper can easily unbolt and disengage the stick or hinge pin 132.

Step 5: The helper then puts the stick or hinge pin 132 into the link pin bore 170 of the second excavator attachment (e.g., a ripper 52).

Step 6: The operator then lowers the boom 122 and moves the stick 124 outward to lower the first excavator attachment 50 to the ground and unhook the excavator attachment alignment tool 10 from the attachment pin 132 of the first excavator attachment 50.

Step 7: The operator then engages the excavator attachment alignment tool 10 lower hook portion 32 with the link pin 132 of the second excavator attachment 52, and lifts the boom 122 so that the second excavator attachment is hanging freely. (The second excavator attachment pin 134 is now parallel and centered, e.g., see FIG. 8.) The operator then retracts the bucket cylinder 130 so that the stick bosses 170 of the second excavator attachment 52 are positioned near the stick end 124

Step 8: The helper then engages the attachment pin 134 into the bosses 172 of the second excavator attachment 52 and the stick boss 170 by swinging or rocking the second excavator attachment 52 (with his hand), into an easy insertion position. He then bolts the attachment pin 134 into place.

Step 9: The operator then extends the bucket cylinder 130 so that the excavator attachment alignment tool 10 is unhooked from the link pin 134 and the link boss 174 is close to the second attachment link boss 176 and the helper removes the excavator attachment alignment tool 52 (see FIG. 9)

Step 10: The helper finally inserts the link pin 134 by swinging the excavator attachment 52 fore and aft with his hand, inserts the pin locking bolts 150, and secures the nut 152. The procedure is then complete!

The entire process described above can also be completed by the operator working alone; however, this would require that the operator make several trips in and out of the cab. The excavator attachment alignment tool 10 of the disclosure works easily because when the first and second portions 12, 14 of the excavator attachment alignment tool 10 are pushed together on the link 142 (or the stick 124), the inner diameter of the hook 32 is the same width or diameter as the link pin 134 or stick or hinge pin 132), thus automatically positioning the excavator attachment 50 or 52 with the attachment pins 132, 134 disposed parallel to each other, and the excavator attachment is centered properly on the machine, with the longitudinal center plane of the excavator attachment is in alignment with the longitudinal center plane of the link 142 (or the stick 124). Due to this positioning of the center of gravity of the excavator attachment, the excavator attachment alignment tool 10 allows the pins 132, 134 to be relieved of pressure, thus allowing insertion, removal, and rotational alignment of the pin bolts 150 to be easier.

Figure 7:
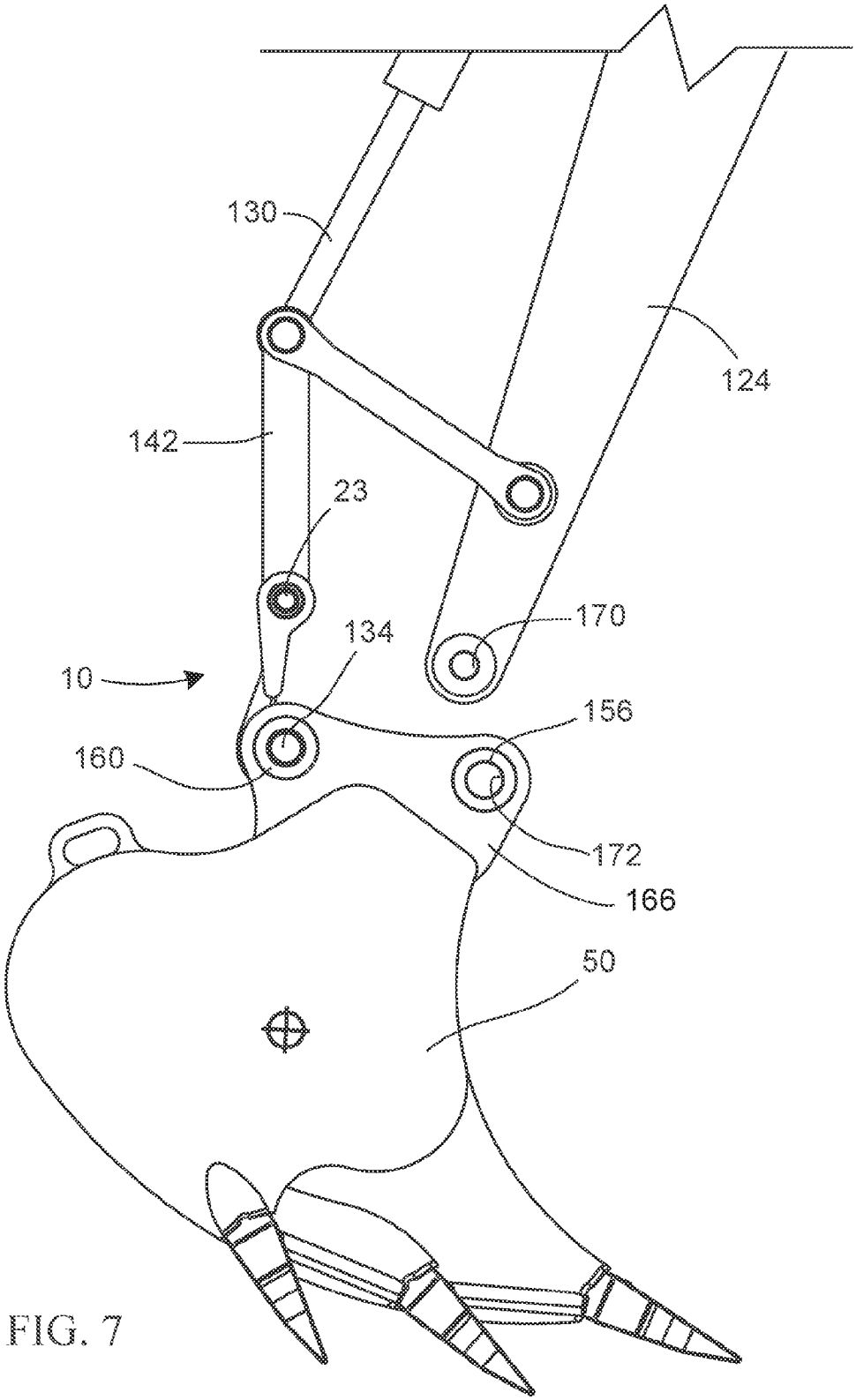
FIG. 7 is a left side view of the excavator stick and linkage, with the stick pivot unattached, and the excavator attachment (the bucket) hanging from the hook portion of the excavator attachment alignment tool of the disclosure connected to the link pivot, with the bucket center of gravity directly below the link pivot, and in alignment with the excavator attachment pin axis.

Also, referring to FIG. 7, the excavator attachment alignment tool 10 is configured and arranged, when in use to accommodate and support an engaged excavator attachment pin (link pin or pivot 134), to hold the excavator attachment pin with its axis parallel to an axis of the excavator linkage pin (cross tube 23), with an attachment lateral center plane including the excavator attachment pin axis disposed coplanar with a linkage stick lateral center plane including the excavator linkage pin axis.

A number of embodiments of the invention have been described. Nevertheless, it will be understood that various modifications may be made without departing from the spirit and scope of the invention. For example, the excavator attachment alignment tool 10 can be used on the stick pivot 170, as well as on a link pivot 174.

Also, other means for keeping the alignment tool body portions 12, 14 from rotating can be employed. For example, the cross tube 20 may be splined with mating grooves inside the opposite halves, thereby to resist relative rotation. The excavator attachment alignment tool hook can be manufactured from round stock bars, rather than plates. In use, the excavator attachments alignment tool can be reversed, e.g., so that the cross tube 20 is connected to the excavator attachment and the alignment tool hook portions 12, 14 straddle the link pin 134 and engage onto the ends of the attachment pin in the link bore.

Accordingly, other embodiments are within the scope of the following claims.

What is claimed is:

1. An excavator attachment alignment tool comprising:

a first alignment tool body portion and a cooperating second alignment tool body portion, the first and second cooperating alignment tool body portions mounted to a cross tube;

the cross tube defining an alignment tool axis; and the cooperating alignment tool body portions being moveable relative to said cross tube into engagement to define a tapering, lower hook portion having opposed, spaced surfaces to accommodate and support an engaged excavator attachment pin in a position parallel with said alignment tool axis, the tapering, lower hook portion being positionable for lifting engagement with the excavator attachment pin, a pair of axially aligned cylindrical bushings mounted to opposed surfaces of the cooperating alignment tool body portions in alignment with said alignment tool axis, said cross tube engaged with and extending generally between said axially aligned cylindrical bushings;

wherein, spacing of said cooperating alignment tool body portions, with said cylindrical bushings mounted thereto, is fixedly adjustable along said alignment tool axis for accommodating a width of an associated excavator link or excavator stick to which an excavator attachment is to be attached or to be removed so that when attached, said excavator attachment has a center plane that is coplanar with a center plane of the excavator link or excavator stick; and wherein, the pair of cooperating alignment tool body portions is mounted in a manner to resist independent rotation of either of said pair of alignment tool body portions.

2. The excavator attachment alignment tool of claim 1, wherein at least one end of said cross tube is fixedly attached to a body portion of said pair of cooperating alignment tool body portions.

3. The excavator attachment alignment tool of claim 1, wherein the spacing of said cooperating first and second alignment tool body portions defines a first width between opposed inner surfaces of the cooperating first and second alignment tool body portions equal to a second width of the cooperating first and second alignment tool body portions at the lower hook portion.

4. The excavator attachment alignment tool of claim 1, wherein said excavator attachment alignment tool further comprises at least one member for locking axial positioning of at least one alignment tool body portion of said pair of cooperating alignment tool body portions relative to said cross tube.

5. The excavator attachment alignment tool of claim 4, wherein said member for locking axial position of said at least one alignment tool body portion is a locking collar.

6. The excavator attachment alignment tool of claim 1, wherein said opposed cylindrical bushings are sized for engagement within openings at opposite ends of an excavator stick boss or at opposite ends of an excavator link boss.

7. The excavator attachment alignment tool of claim 6, further comprising a pair of sleeve bushings, each sleeve bushing having an inner surface of diameter sized to be received over an outer surface of one of the cylindrical bushings in supporting engagement, and each sleeve bushing having an outer surface of diameter selected to be received within the openings at opposite ends of the excavator stick boss or at opposite ends of the excavator link boss in supporting engagement, thereby to accommodate use of the excavator attachment alignment tool with excavators having openings at opposite ends of the excavator stick boss or at opposite ends of the excavator link boss of a relatively greater diameters compared to the cylindrical bushings.

8. The excavator attachment alignment tool of claim 1, wherein the cooperating alignment tool body portions further comprise one or more guide plates mounted for sliding interengagement between said alignment tool body portions in a manner to resist independent rotation of either alignment tool body portion.

9. The excavator attachment alignment tool of claim 1, wherein the alignment tool body portions and the cross tube define cooperating interengageable structure for resisting independent rotation of either body portion.

10. The excavator attachment alignment tool of claim 1, wherein the lower hook portion is tapered toward the tip.

11. The excavator attachment alignment tool of claim 1, wherein, with said excavator alignment tool engaged within the openings at opposite ends of the excavator stick boss or at opposite ends of the excavator link boss, and with an excavator attachment suspended by the hook portion of said excavator attachment alignment tool engaged with an excavator attachment pin having an excavator attachment pin axis, the excavator alignment tool axis and the excavator attachment pin axis engaged by said lower hook portion are disposed parallel to each other and disposed in alignment with the center of gravity of the suspended excavator attachment.

12. An excavator attachment alignment tool, said alignment tool configured and arranged, when in use, to accommodate and support an engaged excavator attachment pin having an excavator attachment pin axis, to hold the excavator attachment pin with the excavator attachment pin axis parallel to an alignment tool axis, and to hold an attachment longitudinal center plane co-planar with a linkage stick longitudinal center plane, wherein, with an excavator attachment suspended from said alignment tool, the attachment pin axis and the alignment tool axis are parallel, and define a second lateral plane that includes a center of gravity of the excavator attachment, thereby relieving radially-directed forces impeding insertion and removal of excavator attachment linkage pins and pin locking bolts.

13. A method for mounting and dismounting an excavator attachment using an excavator attachment alignment tool of claim 12, comprising the steps of:

with an excavator machine running, lifting a presently mounted excavator attachment off the ground;

extending or retracting a bucket cylinder to position the presently mounted excavator attachment with its center of gravity directly below a stick pivot;

with the excavator attachment link pin now under little or no pressure, unbolting and pushing the link pin from the excavator link bore;

swinging the link out of the way and inserting the attachment link pin back into the link bore of the first excavator attachment with no link;

connecting the upper end of the excavator attachment alignment tool into one end of the link;

positioning a lower hook portion of the excavator attachment alignment tool to generally encircle the first excavator attachment link pin;

securing the excavator attachment alignment tool together with a proper width matching the width of the link;

retracting the bucket cylinder to the first excavator attachment until its center of gravity is positioned directly below the link, with the excavator attachment link pin now being parallel to the excavator link pin bore, and the attachment center plane being aligned with the link center plane, and with the link vertical;

with the pin under no pressure, unbolting and disengaging the stick or hinge pin;

inserting the stick or hinge pin into the link pin bore of the second excavator attachment;

lowering the boom and moving the stick outward to lower the first excavator attachment to the ground, and releasing the excavator attachment alignment tool from the attachment pin of the first excavator attachment, with the second excavator attachment link pin now being parallel to the excavator link pin bore and the second excavator attachment longitudinal center plane now being aligned with the longitudinal excavator link center plane;

engaging the excavator attachment alignment tool lower portion with the link pin of the second excavator attachment, and lifting the boom so that the second excavator attachment hangs freely;

retracting the bucket cylinder so that the stick bosses of the second excavator attachment are positioned near the stick end;

engaging the attachment pin into the bosses of the second excavator attachment and the stick boss by swinging or rocking the second excavator attachment into an easy insertion position, and bolting the attachment pin into place;

extending the bucket cylinder so that the excavator attachment alignment tool is released from the link pin and the link boss is close to the second attachment link boss;

removing the excavator attachment alignment tool; and inserting the link pin by swinging the excavator attachment fore and aft by hand, inserting the pin locking bolts, and securing the nut.

* * * * *